US006832454B1

(12) United States Patent
Iyer

(10) Patent No.: US 6,832,454 B1
(45) Date of Patent: Dec. 21, 2004

(54) BEAM FILLED WITH MATERIAL, DECK SYSTEM AND METHOD

(75) Inventor: Srinivasa L. Iyer, Rapid City, SD (US)

(73) Assignee: South Dakota School of Mines and Technology, Rapid City, SD (US)

( * ) Notice: Subject to any disclaimer, the term of this patent is extended or adjusted under 35 U.S.C. 154(b) by 366 days.

(21) Appl. No.: 09/620,134

(22) Filed: Jul. 20, 2000

Related U.S. Application Data

(60) Provisional application No. 60/145,954, filed on Jul. 28, 1999.

(51) Int. Cl.[7] ..... E04C 5/08

(52) U.S. Cl. ..... 52/223.4; 52/223.1; 52/723.2; 52/736.1; 52/738.1; 52/724.5; 52/745.17

(58) Field of Search ..... 52/223.4, 223.1, 52/223.14, 721.5, 723.2, 736.1, 738.1, 723.1, 309.17, 726.2, 726.3, 726.4, 730.2, 736.3, 737.1, 721.1, 721.4, 724.1, 724.5, 223.7, 223.9, 745.17

(56) References Cited

U.S. PATENT DOCUMENTS 3,086,273 A * 4/1963 Welborn ..... 52/223.4
3,858,374 A * 1/1975 Ben-Zvi ..... 52/223.8
4,260,127 A * 4/1981 Nakamura et al. ..... 249/207
4,644,726 A * 2/1987 Wheeler ..... 52/677
5,253,458 A * 10/1993 Christian ..... 52/233
5,509,759 A * 4/1996 Keesling ..... 405/232
5,580,480 A * 12/1996 Chatelain ..... 249/51
5,675,956 A * 10/1997 Nevin ..... 52/726.1
5,761,875 A * 6/1998 Oliphant et al. ..... 52/223.4
5,909,984 A * 6/1999 Matthews ..... 405/257
5,960,597 A * 10/1999 Schwager ..... 52/223.4
6,123,485 A * 9/2000 Mirmiran et al. ..... 405/252
6,189,286 B1 * 2/2001 Seible et al. ..... 52/721.4
6,219,988 B1 * 4/2001 Mahfouz et al. ..... 52/721.4

* cited by examiner

*Primary Examiner*—Carl D. Friedman
*Assistant Examiner*—Chi Q. Nguyen
(74) *Attorney, Agent, or Firm*—Nixon & Vanderhye P.C.

(57) ABSTRACT

A construction beam includes a tubular housing preferably formed of a fiber-reinforced polymer filled with a solid filler material such as concrete. The Poisson's ratio of the tubular housing is less than the filler material to provide confinement of the filler material. One or more reinforcing rods or cables may be embedded in the filler material and prestressed prior to setting the filler material to control cracking of the filler material and to allow for an increased moment of inertia and stiffness. The resulting construction is particularly strong, lightweight and essentially impervious to environmental conditions.

11 Claims, 1 Drawing Sheet

BEAM FILLED WITH MATERIAL, DECK SYSTEM AND METHOD

This application claims the benefit of U.S. Provisional Patent Application Ser. No. 60/145,954, filed Jul. 28, 1999, the entire content of which is herein incorporated by reference.

BACKGROUND AND SUMMARY OF INVENTION

The present invention relates to beam construction and, more particularly, to a beam constructed of a tubular housing filled with a filler material such as concrete, a deck system using such beams, and a method of manufacturing the beams.

Timber-plank bridge decks are a popular type of bridge deck used in the Northeast and Northwest areas of the United States. By placing 2×10 or 2×12 joists side-by-side and introducing post-tensioning strands through the joists in the transverse direction, an economical bridge deck system can be built relatively quickly and easily. The problem with this type of bridge arises from the wood. The wood can exhibit substantial creep properties resulting in the continual loss of post-tensioning stress. In addition, when subjected to a moist climate, the wood can begin to rot, thus resulting in its required replacement.

The discovery of new construction materials for this type of civil engineering application has thus become an increasingly popular engagement. Materials such as fiberglass reinforced plastics (FRP) are strong, non-corrosive, and attractive. Fiberglass has a high strength-to-weight ratio and can be easily manufactured for many different types of applications. An FRP section alone will not work, however, because the modulus of an FRP section is insufficient to provide the required stiffness for construction applications such as a deck, and prestressing in the transverse direction is not possible as the wall thickness of the web is not strong enough to take the anticipated load. To strengthen the beam, fiberglass tubes can be filled with concrete, the most popular and economical construction material in the world, to form a solid beam capable of withstanding significant loads. With the introduction of prestressing to the concrete within the tubes, deflection and cracking of the concrete can be controlled. These filled tubes can be placed side-by-side, similar to the wood joists, and post-tensioned transversely for use in a bridge deck system or the like.

This invention addresses filling the tubes with concrete to increase the moment of inertia of the sections and addresses prestressing the stiffness for the sections. By filling the tube with concrete, the transverse prestressing force in the deck construction can be increased to provide a higher distribution width for the bridge deck compared to a wood deck system. This in turn yields a better, more efficient and cost effective deck system for bridges to meet stiffness and strength requirements.

The tube confines the concrete inside the tube due to the prestressing in the longitudinal direction, which creates an expansion of concrete in the lateral direction (Poisson's ratio effect) that is prevented by the tube, which has a Poisson's ratio less than that of the concrete. This confinement increases the strength of the concrete inside the tube to make this system much more attractive for structural applications such as bridges.

The system does not require the costly formwork for concrete decks, or curing of concrete. No steel reinforcements that develop corrosion are included, and hence, the beams are very durable compared to wood or reinforced concrete. The beams can be used for any construction previously using wood beams, concrete beams and even steel beams, such as temporary structures, scaffolding platforms and building floors where stiffness requirements may or may not be critical.

Internal and external spiral reinforcements in concrete provide varying degrees of confinement to concrete. Steel tubes/spiral reinforcements are used in concrete, but seldom achieve very high confinement. Using an FRP material (with proper Poisson's ratio) or like material provides very high confinement to increase the compressive (up to 10 times) and shear strength of confined concrete. An important consideration is to keep the Poisson's ratio of the tube less than concrete to provide the confinement to concrete. This increased strength depends on the fiber architecture and the thickness of the tube.

In accordance with an exemplary embodiment of the invention, a construction beam includes a tubular housing filled with a solid material, wherein a Poisson's ratio of the tubular housing is less than the solid material to thereby confine the solid material. The construction beam may further include at least one reinforcing rod in the tubular housing such that the solid material surrounds the reinforcing rod. Preferably, the reinforcing rod is prestressed in the tubular housing. In one embodiment, the solid material is concrete, which is formed in the tubular housing after placing the reinforcing rod. The housing itself is preferably formed of a fiber-reinforced polymer such as fiberglass, carbon, Kevlar and the like. The solid material may be one of concrete, fiber-reinforced concrete, polymer concrete, sand, structural foam and the like. Additionally, the reinforcing rod may be formed of steel, carbon, fiberglass, Kevlar and the like. The tubular housing generally may be formed with any geometrically-shaped cross section.

In accordance with another exemplary embodiment of the invention, a deck system includes a plurality of the construction beams of the invention secured side-to-side. In this context, each of the construction beams may further include at least one transverse aperture therein defining a corresponding at least one transverse channel. At least one reinforcing bar may be extended through the transverse channel. In one embodiment, the reinforcing bar extending through the transverse channel is secured under tension to provide a transverse post-stress in the deck system.

In accordance with still another embodiment of the invention, a method of forming a construction beam includes the step of filling a tubular housing with a solid material, wherein a Poisson's ratio of the tubular housing is less than the solid material to thereby confine the solid material.

BRIEF DESCRIPTION OF THE DRAWINGS

These and other aspects and advantages of the present invention will be described in detail with reference to the accompanying drawings, in which.

DETAILED DESCRIPTION OF PREFERRED EMBODIMENTS

Figure 1:
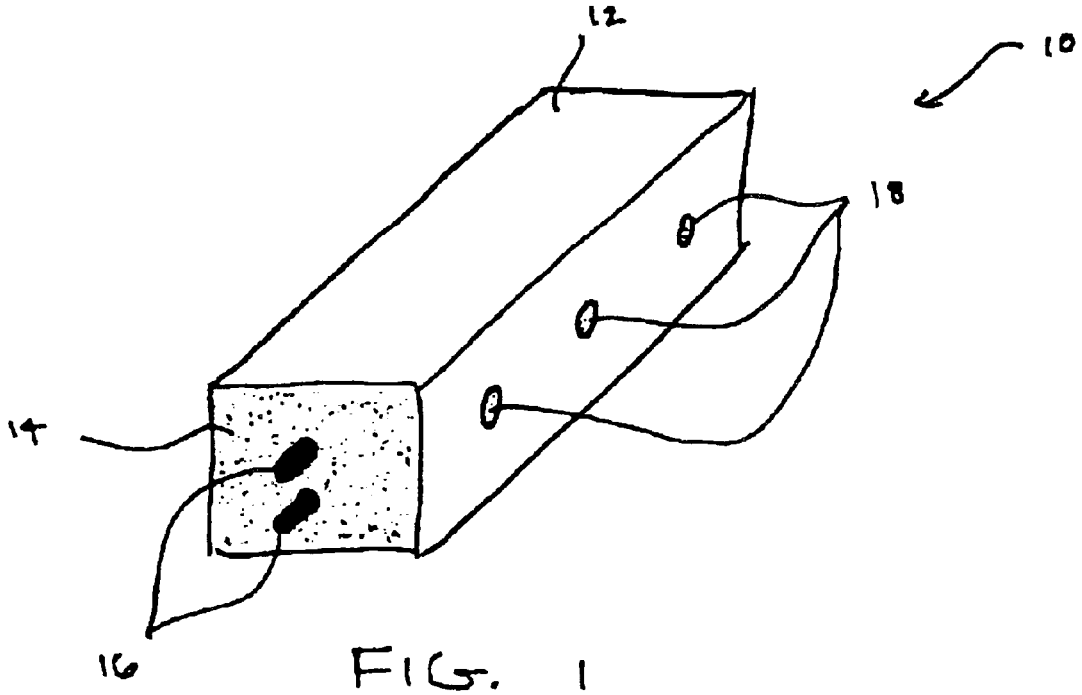
FIG. 1 is a perspective view of an exemplary construction beam according to the present invention.

Referring to FIG. 1, a construction beam 10 is formed of a tubular housing 12 filled with a solid material 14. As shown, the beam 10 is formed in a generally square or rectangular shape, however, any geometric shape such as triangle, circle, hexagon, etc. could be formed. The material of the tubular housing 12 is preferably a fiber-reinforced polymer (FRP) such as fiberglass, carbon, Kevlar or the like. The solid filler material 14 can be any material that resists high compressive strength in a confined environment. Preferably, the filler. material 14 is concrete, fiber-reinforced concrete, polymer concrete, sand, structural foam or the like.

Using a fiber-reinforced polymer or like material for the tubular housing 12 provides a very high confinement to increase the compressive and shear strength of the confined filler material 14. To provide the confinement of the filler material 14, the Poisson's ratio of the tubular housing 12 is kept less than the filler material 14, which is particularly important for lateral confinement by the tube in the absence of prestressing. This increased strength depends on the fiber architecture and the thickness of the tube 12. The fiber architecture is the direction of fiber and amount of fiber used to make the tube. This architecture influences properties of the tube such as Poisson's ratio, modulus of elasticity and strength of the tube.

With continued reference to FIG. 1, one or more reinforcing members 16 are embedded in the filler material 14. The reinforcing rods or cables 16 can be formed of steel, carbon, fiberglass, Kevlar or any fiber-reinforced polymer material, or the like. In order to increase the tensile capacity of the filler material, the reinforcing rods or cables 16 are placed under tension prior to filling the tubular housing 12 with the filler material 14. This tensioning or stressing using a pretension method, so-called "prestressing," of the beam 10 helps to control cracking of the concrete and allows for an increased moment of inertia and stiffness. The increase in moment of inertia and increase in stiffness cause less overall deflection. The prestressing also causes the concrete to bond with the tube due to the slight expansion of the concrete due to the prestress force.

In an exemplary construction beam, the reinforcing rods or cables 16 are inserted in the tubular housing 12 and secured in position by plates or the like with holes therein. After each plate is properly positioned, a chuck is placed on each cable 16 and the cable is secured by hand. A hydraulic jack can then be placed on the cable, and the cables are placed under tension. With normal prestressing with steel cables, prestressing values range from 60–70% of the ultimate strength of steel cables, which is controlled by the American Concrete Institute—Code for Prestressing Concrete with Steel Cables. Similar conditions are available for other cables using fiber-reinforced polymer materials.

The tubular housing 12 is then filled with the filler material 14 such as concrete. Placement of the concrete can be done using a grout pump that delivers the concrete through a fixed diameter hose such as a four-inch diameter hose. The concrete is consolidated by tapping the housing 12 with a rubber mallet and using a two-inch diameter, eight foot long vibrating apparatus. The frames are preferably secured to ensure that the prestressing cables 16 are centered. The top and bottom of the tubular housing 12 should be tied to the prestressing frame to prevent movement of the tube during concrete placement.

The concrete is then allowed to cure until a desired compressive strength is achieved. Subsequently, the pretensioning of the cables or rods 16 is released by cutting the cables 16 using an acetylene torch or the like.

Prior to prestressing the beam 10 and filling with the filler material 14, a plurality of transverse apertures 18 are formed through the tubular housing 12. The apertures 18. aligned with corresponding apertures in adjacent beams 10, define a transverse channel for receiving a post-stressing reinforcing member 20. (See FIG. 2). During the beam forming operation, the transverse apertures 18 are blocked to prevent concrete from filling the spaces using, for example, electrical conduit, wood dowels, foams or the like. In the case of wood dowels, for example, once the filler material 14 is set or cured, the dowels can be drilled out to re-open the apertures 18.

In an alternative construction, the reinforcing cables or rods 16 may be subjected to stress using a post-tension method or "post-stressing" as opposed to prestressing with similar benefits. In this context, an aperture or channel can be formed along a longitudinal axis of the beam for receiving the reinforcing cables or rods 16 after insertion of the filler material 14. Once inserted, the rods 16 are placed under tension and secured.

Figure 2:
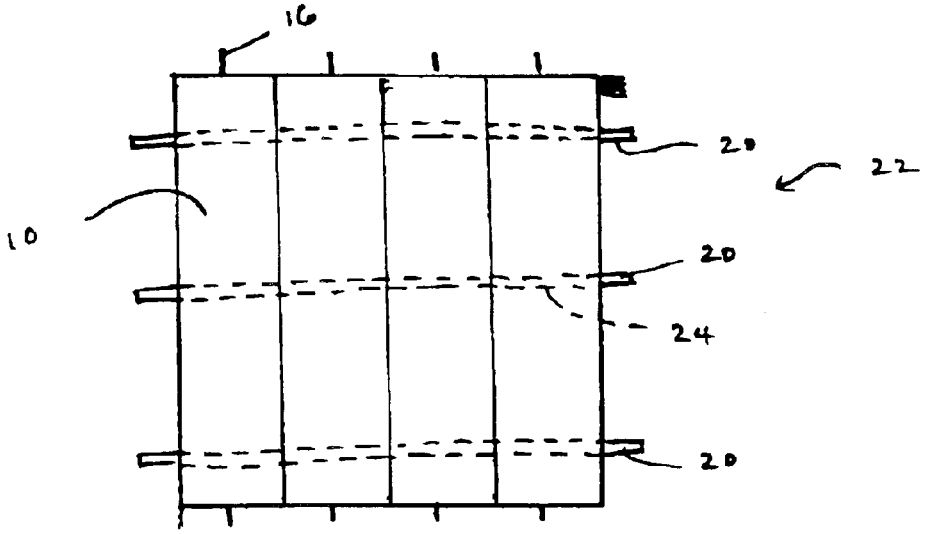
FIG. 2 is a plan view of a deck system constructed using construction beams according to the present invention.

Referring to FIG. 2, the construction of a deck system 22 using the construction beam 10 according to the invention will be described. A plurality of beams 10 are aligned such that the transverse apertures 18 of each beam are aligned with apertures of an adjacent beam to define a transverse channel 24. The reinforcing rods or bars 20 are inserted through each of the transverse channels 24 and secured to steel plates or the like for post-tensioning. The steel base plates serve to improve the distribution of the post-tensioning force on the deck 22. A hydraulic jack or the like is then secured to the transverse reinforcing bars 20, and the bars 20 are placed under tension. Stressing of the reinforcing rods 20 can be performed at once or one at a time. Once stressed, the rods 20 are secured using a nut or chuck or the like, and the hydraulic jack is released.

The concrete filled construction beam with or without prestressing has a low modulus and hence is controlled by deflection requirements. The deflection requirements can be addressed by increasing the moment of inertia of the section, which will in turn increase the cross section and self-weight of the structure and also will increase the prestressing force required for the structure. With the structure according to the present invention, the moment of inertia of the construction beam can be increased without increasing the cross sectional area of the section. This also increases the confinement of the filled material in case of large sections. A confined concrete, for example, can develop a strength that is ten times that of ordinary concrete, and by prestressing, the section can easily take 20,000 psi or more in tension and compression and it can compete with structural steel, while being very economical to use over conventional reinforced concrete or steel. At the same time, the FRP tubular construction beam will not corrode, rot, shrink or expand due to moisture conditions. If the filler material such as concrete is cracked, the fiber-reinforced polymer tubular housing is strong in tension and thereby will carry the load. The high strength-to-weight ratio of the preferred materials keeps the construction beam relatively light with very high strength characteristics.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A deck system comprising a plurality of construction beams secured side-to-side, wherein each of the construction beams comprises a tubular housing filled with a solid material having a Poisson's ratio, wherein the tubular housing is constructed such that a Poisson's ratio of the tubular housing is less than the solid material, the respective tubular housings forming part of each of the construction beams, wherein each of the construction beams further comprises at least one transverse aperture therein defining a corresponding at least one transverse channel, the deck system further comprising at least one reinforcing bar extending through the transverse channel.

2. A deck system according to claim 1, further comprising at least one reinforcing rod in the tubular housing such that the solid material surrounds the reinforcing rod.

3. A deck system according to claim 2, wherein the at least one reinforcing rod is stressed using one of a pretension method and a post-tension method in the tubular housing.

4. A deck system according to claim 1, wherein the tubular housing is formed of a fiber reinforced polymer.

5. A deck system according to claim 4, wherein the solid material is concrete.

6. A deck system according to claim 5, further comprising at least one reinforcing rod in the tubular housing.

7. A deck system according to claim 6, wherein the reinforcing rod is formed of a material selected from the group comprising steel, carbon, fiberglass, and Kevlar.

8. A deck system according to claim 4, wherein the solid material is a material selected from the group comprising concrete, fiber reinforced concrete, polymer concrete, sand, and structural foam.

9. A deck system according to claim 4, wherein the tubular housing is formed of a material selected from the group comprising fiberglass, carbon, and Kevlar.

10. A deck system according to claim 1, wherein the tubular housing comprises a geometrically-shaped cross-section.

11. A deck system according to claim 1, wherein the at least one reinforced bar is secured in the transverse channel under tension to provide a transverse post-stress in the deck system.

* * * * *